US007135945B2

(12) United States Patent
Whipple et al.

(10) Patent No.: US 7,135,945 B2
(45) Date of Patent: Nov. 14, 2006

(54) TRIP INDICATOR AND ELECTRICAL SWITCHING APPARATUS EMPLOYING THE SAME

(75) Inventors: Michael J. Whipple, Rochester, PA (US); Edward E. Lias, Aliquippa, PA (US); Jeff S. Gibson, Hookstown, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/078,846

(22) Filed: Mar. 11, 2005

(65) Prior Publication Data

US 2006/0202785 A1 Sep. 14, 2006

(51) Int. Cl.
*H01H 73/12* (2006.01)

(52) U.S. Cl. ..... 335/17

(58) Field of Classification Search ..... 335/17
See application file for complete search history.

(56) References Cited

U.S. PATENT DOCUMENTS

| | | | | |
|---|---|---|---|---|
| 3,401,363 | A | 9/1968 | Vyskocil et al. | |
| 3,443,258 | A | 5/1969 | Dunham et al. | |
| 4,166,989 | A | 9/1979 | Castonguay et al. | |
| 5,694,101 | A | 12/1997 | Lavelle et al. | |
| 5,831,500 | A | 11/1998 | Turner et al. | |
| 5,847,913 | A | 12/1998 | Turner et al. | |
| 5,981,887 | A | 11/1999 | Robarge et al. | |
| 6,107,902 | A | 8/2000 | Zhang et al. | |
| 6,246,304 | B1 * | 6/2001 | Gasper | 335/17 |
| 6,380,501 | B1 | 4/2002 | Figueroa et al. | |
| 6,542,056 | B1 | 4/2003 | Nerstrom et al. | |
| 6,639,492 | B1 | 10/2003 | Hall et al. | |
| 6,803,535 | B1 | 10/2004 | Whipple et al. | |

OTHER PUBLICATIONS

U.S. Appl. No. 10/782,624, Michael J. Whipple.

* cited by examiner

*Primary Examiner*—Ramon M. Barrera
(74) *Attorney, Agent, or Firm*—Martin J. Moran

(57) ABSTRACT

A trip indicator is for a circuit breaker having a housing including first and second openings, separable contacts and an operating mechanism having an operating handle for opening and closing the separable contacts. The trip indicator includes a trip indicating member with a first end having a trip indicia and a second end with first and second projections. The first projection is engaged by a cradle of the operating mechanism when the separable contacts are not tripped, in order to prevent the trip indicia from being viewable at the second opening of housing. The first projection is disengaged and released when the separable contacts trip, causing the trip indicating member to move in order that the trip indicia is viewable at the second opening. A locking feature in which the second projection engages and locks operating handle, is also disclosed.

16 Claims, 4 Drawing Sheets

TRIP INDICATOR AND ELECTRICAL SWITCHING APPARATUS EMPLOYING THE SAME

BACKGROUND OF THE INVENTION

1. Field of the Invention

The present invention relates generally to electrical switching apparatus and, more particularly, to a trip indicator for a circuit breaker. The invention also relates to circuit breakers including a trip indicator.

2. Background Information

Circuit breakers are generally old and well known in the art. Examples of circuit breakers are disclosed in U.S. Pat. Nos. 5,341,191 and 5,471,184. Circuit breakers are used to protect electrical circuitry from damage due to a trip condition, such as, for example, an overcurrent condition, an overload condition, an undervoltage condition, or a relatively high level short circuit or fault condition. Molded case circuit breakers, for example, include at least one pair of separable contacts which are operated either manually by way of a handle disposed on the outside of the case, or automatically by way of a trip unit in response to the trip condition.

Circuit breakers typically have two or three operating handle positions corresponding to the status of the separable contacts. For example, a three position breaker may include an ON position in which the separable contacts are closed, an OFF position in which the contacts are open, and a tripped position in which the contacts are tripped open. Typically, the handle position corresponding to the tripped position of the contacts is between the ON and OFF positions. However, this is not always the case. In two-position breakers, the tripped operating handle position is shared with the OFF position. Specifically, when the trip condition occurs and the circuit breaker trips, the operating handle is automatically forced to the OFF position. It is difficult to quickly visually determine the status of such circuit breakers. This is problematic and it is even more pronounced when the circuit breaker is only one of a plurality of circuit breakers arranged within the same panelboard or switchboard perhaps with several breakers already intentionally turned OFF. Under such circumstances, it is nearly impossible to determine which circuit breakers have tripped because the operating handle appears in the same position as it does for the breakers which have been intentionally turned OFF.

To help alleviate this problem, known circuit breaker designs employ a variety of trip and status indicators. For example, it is known to provide a trip flag in the circuit breaker to indicate the tripped condition. Generally, the trip indicator comprises an indicator assembly which interacts with the operating handle or cradle of the circuit breaker in order to position a visual indicia, such as the trip flag, or printed words indicative of the circuit breaker status (e.g., "T", "TRIPPED", "ON" or "OFF"), beneath a lens or window which covers an opening in the circuit breaker housing. Typically, the flag or other indicia is actuated, in response to the trip condition, by the cradle. For example, when the cradle unlatches in response to the trip mechanism and pivots, the separable contacts of the circuit breaker are opened. The flag is then reset by relatching the cradle through movement of the operating handle. However, the trip indicia of such indicators are somewhat concealed within the opening in the circuit breaker housing and often can only be clearly seen when viewed from a very close range and substantially straight on through the lens or glass window. This is disadvantageous because, in most circuit breaker applications, many of the circuit breakers are located or positioned at an elevation other than at eye level, thus limiting the effectiveness of the indictor.

Additionally, as previously discussed, in most known trip indicators, the indicator assembly interacts with the operating handle in such a manner that the visual indicia moves therewith. See, e.g., U.S. Pat. No. 6,246,304. Therefore, one can easily reset the circuit breaker from the tripped position by merely moving the operating handle back to the ON position. This is undesirable under certain circumstances where it is advantageous to prevent the breaker from being arbitrarily reset. For example, it is frequently important to evaluate the cause of a circuit breaker trip (e.g., identify the source of the abnormal current condition) before any necessary repairs or corrections can be made in order to resolve the problem. Otherwise, the breaker might continue to trip or damage could occur to electrical equipment in communication with the circuit breaker.

There is a need, therefore, for a trip indicator which provides a visual indication of a tripped circuit breaker condition which can be quickly and easily seen from a variety of viewing positions, and for providing a trip indicator capable of simultaneously locking the breaker in the tripped position in order to, for example, provoke some thought as to why the breaker tripped before simply resetting the handle.

There is, therefore, room for improvement in trip indicators for circuit breakers and in circuit breakers employing trip indicators.

SUMMARY OF THE INVENTION

These needs and others are satisfied by the present invention, which is directed to a circuit breaker and trip indicator therefor comprising a trip indicating member which is movable to protrude at one end from the circuit breaker housing in order to provide a visual indication of a tripped circuit breaker condition. At the opposite end, the trip indicating member engages and locks the operating handle in the tripped position. Before the circuit breaker can be reset, the protruding first end of the trip indicating member is physically depressed by the user, thereby preventing the tripped breaker from inadvertently or arbitrarily being reset.

As one aspect of the invention, a trip indicator is for an electrical switching apparatus including a housing having first and second openings, separable contacts enclosed by the housing, and an operating mechanism having an operating handle with a first end and a second end. The first end of the operating handle protrudes from the first opening of the housing and is structured to open and close the separable contacts. The operating mechanism is structured to trip open the separable contacts in response to a trip condition. The trip indicator comprises: a trip indicating member including a first end and a second end, the first end of the trip indicating member having a trip indicia, the second end of the trip indicating member including a first portion and a second portion, wherein the first portion of the trip indicating member is structured to be engaged by the operating mechanism when the separable contacts are not tripped open, in order to prevent the trip indicia from being viewable at the second opening of the housing, and wherein the first portion is further structured to be disengaged and released by the operating mechanism when the separable contacts are tripped open, causing the trip indicating member to move in order that the trip indicia is viewable at the second opening of the housing and the second portion of the second end of the trip indicating member engages and locks the second end of the operating handle.

The operating mechanism may further have a cradle pivotally mounted within the housing proximate the second end of the operating handle. The cradle may be moveable between latched and unlatched positions corresponding to the separable contacts being closeable and tripped open, respectively, the first portion of the second end of the trip indicating member is structured to be engaged by the cradle when the cradle is latched and the separable contacts are not tripped open, thereby preventing the first end of the trip indicating member from being viewable at the second opening of the housing, and the first portion is structured to be disengaged and released by the cradle when the cradle is unlatched in response to the trip condition tripping open the separable contacts.

The trip indicia may be a protrusion of the first end of the trip indicating member which is structured to protrude from the second opening of the housing when the cradle is in the unlatched position and the separable contacts are tripped open, and which is structured not to protrude when the cradle is latched and the separable contacts are not tripped.

The second end of the operating handle may include a recess. The first and second portions of the second end of the trip indicating member may be first and second projections, wherein the first projection is structured to be engaged and disengaged by the cradle when the cradle is latched and unlatched, respectively, in response to the separable contacts being closeable and tripped open, and the second projection is structured to engage the second end of the operating handle at the recess in order to lock the operating handle when the separable contacts are tripped open, the cradle is unlatched and the first end of the trip indicating member is protruding from the housing. The first projection may further include first and second sides. The first side of the first projection may be structured to be engaged by the cradle when the cradle is latched and the separable contacts are not tripped open. The second side of the first projection may be structured to engage the housing in order to prevent the first end of the trip indicating member from protruding therefrom when the separable contacts are not tripped open and the cradle is latched.

The trip indicating member may further include at least one resilient extension structured to provide a bias of the trip indicating member.

As another aspect of the invention, a circuit breaker comprises: a housing including first and second openings; separable contacts enclosed within the housing; an operating mechanism including an operating handle for opening and closing the separable contacts, the operating handle including a first end and a second end, the first end protruding from the first opening of the housing and moving among OFF. ON and tripped positions corresponding to the separable contacts being open, closed and tripped open, respectively; and a trip indicator comprising: a trip indicating member including a first end and a second end, the first end of the trip indicating member having a trip indicia, the second end of the trip indicating member including a first portion and a second portion, wherein the first portion is engaged by the operating mechanism when the separable contacts are not tripped open, in order to prevent the trip indicia from being viewable at the second opening of the housing, and wherein the first portion is disengaged and released by the operating mechanism when the separable contacts are tripped open, causing the trip indicating member to move in order that the trip indicia is viewable at the second opening of the housing and the second portion of the second end of the trip indicating member engages and locks the second end of the operating handle.

The trip indicating member may be biased towards protruding the protrusion of the first end thereof from the second opening of the housing. The trip indicator may be structured such that the separable contacts, when tripped open, cannot be reset unless the protrusion of the first end of the trip indicating member is first depressed against the bias in order that the second projection disengages the recess at the second end of the operating handle which also causes the second side of the first projection to engage the housing thereby preventing the first end of the trip indicating member from protruding therefrom.

The trip indicating member may further include at least one resilient extension which is structured to provide the bias of the trip indicating member. Alternatively, the housing may further include a bias member, which provides the bias of the trip indicating member. The bias member may be a spring.

The trip indicating member may be made from a resilient material having flexural properties and the housing may further include a catch, wherein the first projection moves between an undeflected position and a deflected position. In the undeflected position, the cradle may not engage the first side of the first projection and the second side of the first projection may not engage the catch, in order that the trip indicating member is free to move in accordance with the bias, when the cradle is unlatched and the separable contacts are tripped open. In the deflected position, the cradle may engage the first side of the first projection in order to deflect it, causing the second side thereof to engage the catch and hold the trip indicating member against the bias, thereby preventing it from protruding from the second opening of the housing when the separable contacts are not tripped and the cradle is latched.

As another aspect of the invention, a circuit breaker comprises: a housing including first and second openings; separable contacts enclosed within the housing; an operating mechanism including an operating handle for opening and closing the separable contacts, the operating handle including a first end and a second end, the first end protruding from the first opening of the housing and moving among OFF, ON and tripped positions corresponding to the separable contacts being open, closed and tripped open, respectively, the cradle pivotally mounted within the housing proximate the second end of the operating handle and moveable between a latched position and an unlatched position corresponding to the separable contacts being tripped open in response to a trip condition; and a trip indicator comprising: a trip indicating member including a first end and a second end, the first end of the trip indicating member having a trip indicia, the second end of the trip indicating member including a first portion and a second portion, wherein the cradle engages the first portion of the second end of the trip indicting member when the cradle is latched and the separable contacts are not tripped open, in order that the first end of the trip indicating member does not protrude from the housing, and wherein the cradle disengages and releases the first portion of the second end of the trip indicating member when the cradle is unlatched and the separable contacts are tripped open, causing the trip indicating member to move in order that the first end of the trip indicating member protrudes from the second opening of the housing.

The second portion of the second and of the trip indicating member may be structured to engage and lock the second end of the operating handle when the separable contacts are tripped open, the cradle is unlatched and the first end of the trip indicating member protrudes from the second opening of the housing.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

For purposes of illustration, the invention will be described as applied to the trip indicator of a circuit breaker, although it will become apparent that it could also be applied to other types of electrical switching apparatus (e.g., without limitation, circuit switching devices and other circuit interrupters, such as, for example, contactors, motor starters, motor controllers and other load controllers) having an operating mechanism with a tripped position.

As employed herein, the term "fastener" refers to any suitable connecting or tightening mechanism expressly including, but not limited to, screws, bolts and the combinations of bolts and nuts (e.g. without limitation, lock nuts) and bolts, washers and nuts.

As employed herein, the statement that two or more parts are "coupled" together shall mean that the parts are joined together either directly or joined through one or more intermediate parts.

As employed herein, the term "trip condition" refers to any abnormal electrical condition which could cause a circuit breaker to trip expressly including, without limitation, an overcurrent condition, an overload condition, an undervoltage condition, or a relatively high level short circuit or fault condition.

As employed herein, the term "trip indicia" refers to any suitable visual indication of a trip condition, expressly including but not limited to a colored indicator, a light emitting diode (LED), a trip flag, a suitable word (e.g., "TRIPPED") or a suitable letter (e.g., "T") or other suitable term or indicia and the exemplary protrusion of the first end of the trip indicating member which protrudes from an opening in the circuit breaker housing in order to indicate the trip condition. Indicia such as the, for example, words "ON" and "OFF" or positive (+) and negative (−) signs, which indicate non-tripped status of the breaker, are also contemplated by the invention.

As employed herein, the term "flexural properties" refers to the resilient nature of the exemplary trip indicating member which is facilitated in large part by the material from which it is made. Specifically, the material is resilient (e.g., flexible) in that it can be temporarily flexed or deflected from a natural position in which no external force is acting upon it, to a deflected position in which it is deflected or displaced from its natural position in response to being engaged and moved by an external force. Upon removing the external force, it will return to the natural position. Certain plastic materials including, without limitation, Lexan® and Delron® are representative resilient materials exhibiting such flexural properties. Lexan® and Delron® resilient materials are commercially available from the General Electric Company having a place of business in Fairfield, Conn.

Figure 1:
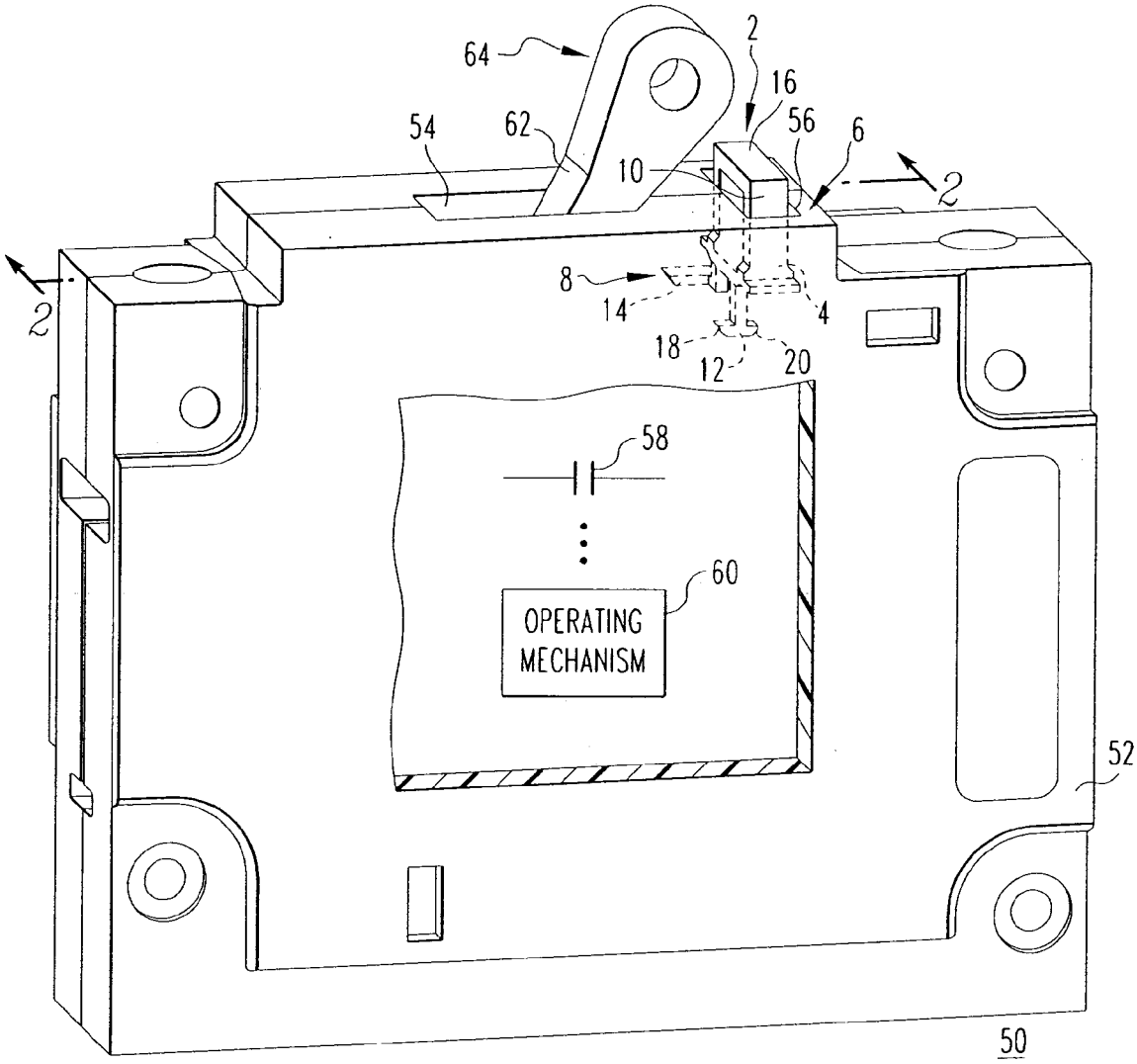
FIG. 1 is an isometric view of a single pole circuit breaker with a trip indicator, in accordance with the present invention, shown in the tripped position with the majority of a trip indicating member shown in hidden line drawing and a portion of the circuit breaker housing cut away to schematically show internal structures.
Figure 3:
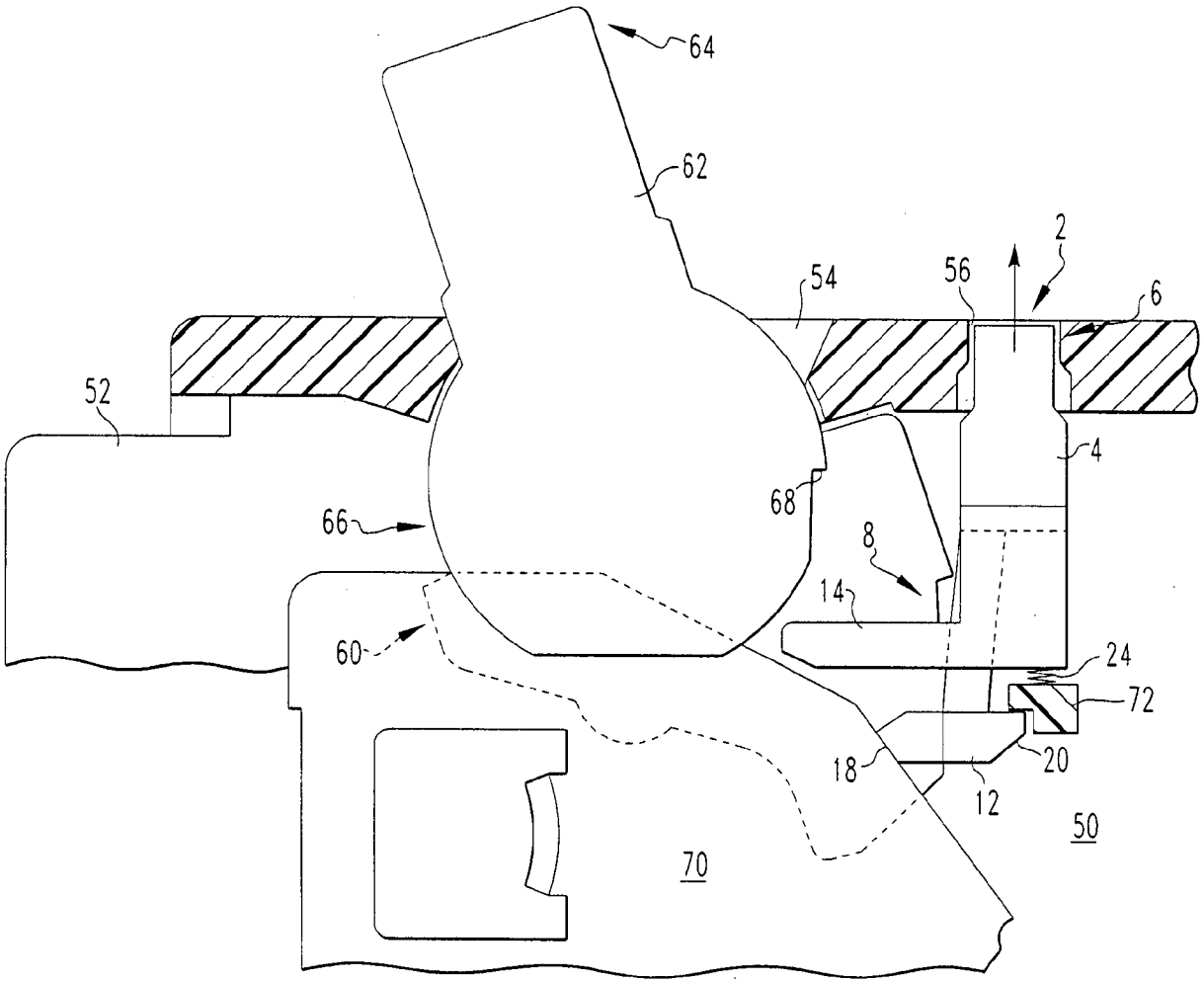
FIG. 3 is a cross-sectional view taken along line 2—2 of FIG. 1 but modified to show the elongated operating handle in the ON position, the cradle latched and the trip indicating member locked in the untripped position.

FIG. 1 illustrates a circuit breaker 50 incorporating a trip indicator 2 in accordance with the present invention. In this example, the circuit breaker 50 is a single-pole circuit breaker including a molded housing 52 having first and second openings 54,56, separable contacts 58 enclosed within the housing 52, and an operating mechanism 60 having an operating handle 62 with first and second ends 64,66 (end 66 is shown in FIG. 3). The operating mechanism 60 is structured to trip open the separable contacts 58 in response to a trip condition. The first end 64 of the operating handle 62 protrudes from the first opening 54 of the housing 52 and is structured to open and close the separable contacts 58. FIG. 1 shows the circuit breaker 50 tripped with the trip indicator 2 protruding from the second opening 56 of housing 52 and the operating handle 62 disposed in the operating position corresponding to the separable contacts 58 being tripped open. The operating handle 62 moves among OFF, ON and tripped positions corresponding to the separable contacts 58 being open, closed and tripped open, respectively. In the exemplary single-pole circuit breaker 50, the operating handle positions for the manually turned OFF (not shown) and tripped (FIGS. 1 and 4) conditions are essentially the same, with the operating handle 62 positioned at an end of first opening 54 of housing 52 (e.g., to the right in FIGS. 1 and 4), in both instances. It will be appreciated, however, that the operating handle (e.g., 62) could alternatively have any known or suitable number and configuration of operating handle positions. For example, it could have three operating positions (not shown), including a separate tripped position (not shown) between the ON and OFF positions. It will also be appreciated that the circuit breaker could alternatively be a multi-pole circuit breaker (not shown) having any number of poles (not shown) with any suitable number of operating handles (not shown) and employing one or more trip indicator, such as trip indicator 2.

Figure 2:
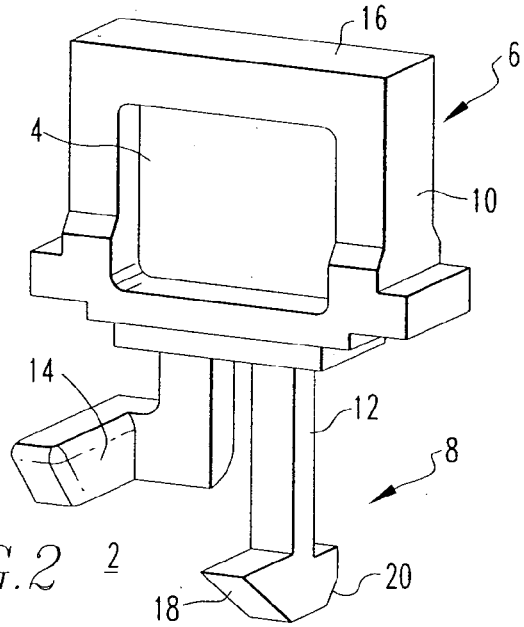
FIG. 2 is an isometric view of the trip indicating member of FIG. 1.

As shown in FIGS. 1 and 2, the exemplary trip indicator 2 includes a trip indicating member 4 having a first end 6 and a second end 8. The first end 6 includes a trip indicia 10 such as the exemplary protrusion 16 which, as shown in FIG. 1, protrudes from the second opening 56 (FIG. 1) of housing 52 in order to provide a readily apparent visual indication of a trip condition. The second end 8 includes first and second portions which, in the example shown and described herein, are first and second projections 12, 14. The first projection 12 includes a first side 18 and a second side 20.

Figure 4:
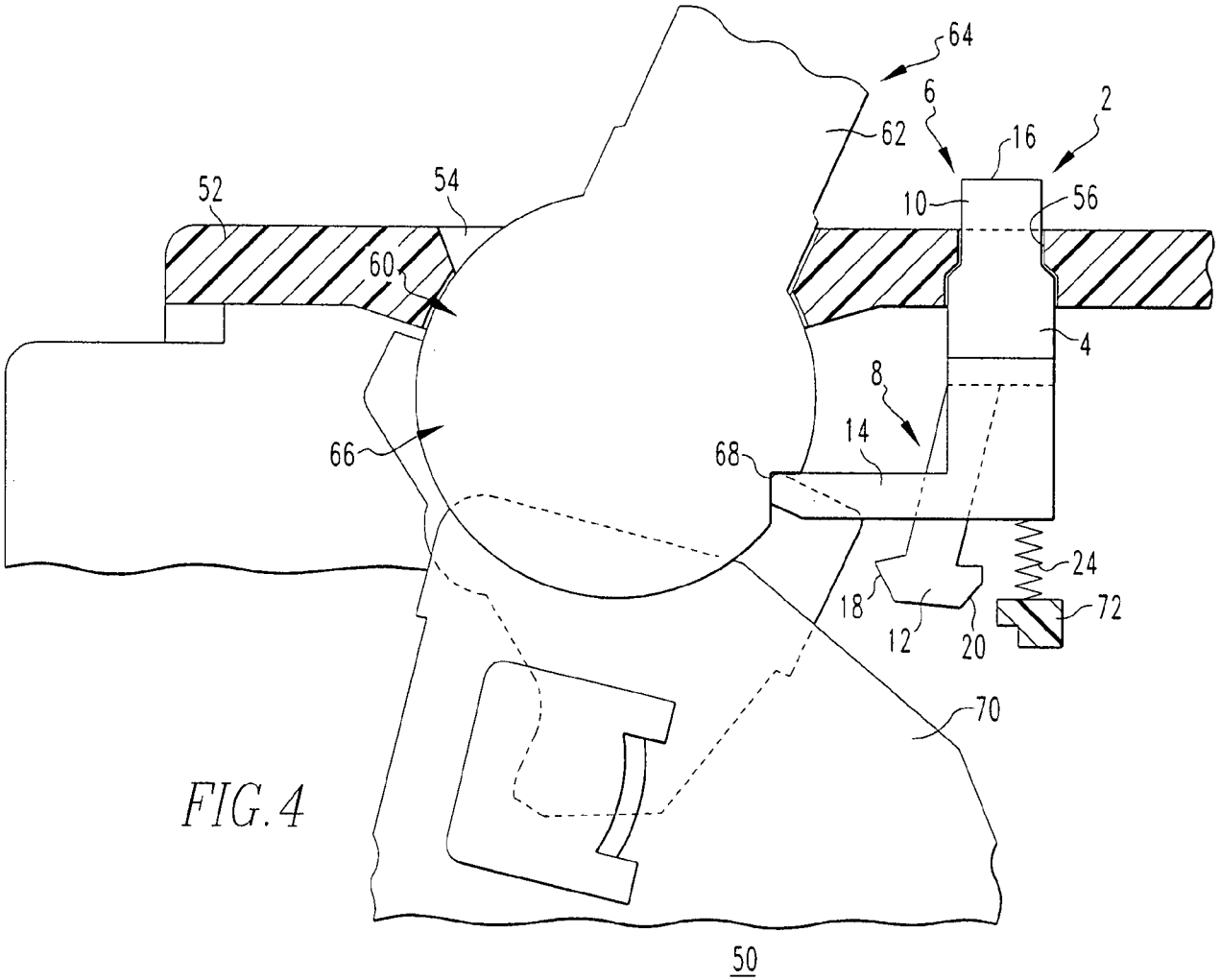
FIG. 4 is another cross-sectional view taken along line 2—2 of FIG. 1 showing the circuit breaker tripped with the cradle unlatched and the trip indicating member protruding from the circuit breaker housing.

FIGS. 3 and 4 provide cross-sectional views of the single-pole circuit breaker 50 of FIG. 1 illustrating the exemplary trip indicator 2 as employed when the circuit breaker 50 is ON (FIG. 3) or OFF but not tripped (not shown) as compared to when the circuit breaker 50 is tripped (FIG. 4). As shown, the exemplary operating mechanism 60 of single-pole circuit breaker 50 further includes a cradle 70 pivotally mounted within the housing 52 proximate the second end 66 of the operating handle 62. The pivotal connection of the cradle 70 to the housing 50 is achieved by any known or suitable mechanism, such as a pivot pin (not shown). The cradle 70 is moveable between latched (FIG. 3) and unlatched (FIG. 4) positions corresponding to the separable contacts 58 (FIG. 1) being closed or closeable and tripped open, respectively.

When the circuit breaker 50 is not tripped as shown in FIG. 3, the first projection 12 of the second end 8 of the trip indicating member 4 is engaged by the cradle 70 when the cradle 70 is latched and the separable contacts 58 are not tripped open. More specifically, the trip indicator 2 is biased towards protruding the first end 6 of the trip indicating member 4 from the second opening 56 of housing 52. In the example of FIG. 3, this bias is provided by a spring, such as the linear spring 24, shown. However, it will be appreciated that the bias could alternatively be provided by the flexural properties of the trip indicating member 4, as will be discussed hereinbelow. The exemplary linear spring 24 is disposed between a catch 72 molded in the housing 52 and the second end 8 of the trip indicating member 4. However, it will be appreciated that any suitable bias member (not shown) other than the exemplary linear spring 24 could be employed in any suitable alternative configuration (not shown) in order to provide the desired bias. When the cradle 70 is latched (e.g., the circuit breaker 50 is not tripped), it engages the first side 18 of first projection 12 displacing it laterally (e.g., to the right in FIG. 3) in order that the second side 20 of the first projection 12 engages the catch 72 of housing 52. In this manner, the trip indicating member 4 is held downward, against the bias, in order to prevent the first end 6 thereof from protruding from the housing 52 when the separable contacts 58 are not tripped open.

Conversely, referring to FIG. 4, when the circuit breaker 50 trips, the separable contacts 58 (FIG. 1) trip open and the cradle 70 unlatches and pivots (e.g., clockwise with respect to FIG. 4). Accordingly, the cradle 70 disengages and releases the first side 18 of first projection 12 of the second end 8 of trip indicating member 4, allowing it to move laterally away from the catch 72 of housing 52 and return to its natural position, as shown. This releases the trip indicating member 4 and allows it to move in accordance with the aforementioned spring bias (e.g., upward with respect to FIG. 4), in order that the trip indicia 10 of the first end 6 of trip indicating member 4 is viewable at the second opening 56 of housing 52. In the example of FIG. 4, this means that the projection 16 of the first end 6 of trip indicating member 4 protrudes from the second opening 56.

In addition to the visual indication provided by the exemplary trip indicator 2, the present invention further provides a locking feature adapted to lock the operating handle 62 in the tripped position (FIG. 4) and prevent the circuit breaker 50 from being reset until the trip indicator 2 is manually depressed against the bias, previously discussed. In the example illustrated and discussed herein, this is accomplished by the second projection 14 at the second end 8 of trip indicating member 4. Specifically, when the circuit breaker 50 trips, the cradle 70 unlatches and the trip indicator 2 is released in order to move upward and protrude from housing 52, the second projection 14 engages a recess 68 in the second end 66 of operating handle 62 (best shown in FIG. 4). In this manner, the second projection 14, when engaged within recess 68, locks the operating handle 62, thereby preventing it from being arbitrarily reset (e.g., preventing it from being rotated counter clockwise with respect to FIG. 4). It will, however, be appreciated that any suitable operating handle 62 and trip indicating member 4 locking configuration, other than the exemplary recess 68 and second projection 14 shown and discussed herein, could alternatively be employed. For example, without limitation, rather than the exemplary recess 68, the second end 66 of the operating handle 62 could be made to include a projection (not shown) structured to be engaged and locked by a projection (e.g., 14) of the trip indicating member 4.

The aforementioned locking feature of the present invention provides a significant safety feature. It prevents the operating handle 62 from being pivoted in order to reset the circuit breaker 50 arbitrarily, without provoking some forethought. This is important in order to resist merely resetting the tripped breaker 50 without first investigating as to the cause and the source of the trip condition. Resetting the circuit breaker 50 without first determining the cause of the trip condition, could result in the circuit breaker 50 repetitively tripping, or worse, it could result in damage to electrical equipment in electrical communication with the circuit breaker 50. The trip indicator 2 of the present invention resists these undesirable scenarios by not permitting the separable contacts 58 (FIG. 1) to be reset from a tripped open position unless the protrusion 16 of the first end 6 of the exemplary trip indicating member 4 is first depressed against the bias causing the second projection 14 to disengage the recess 68 at the second end 66 of the operating handle 62, thereby unlocking it. This also causes the cradle 70 to engage and displace the first side 18 of first projection 12 laterally (to the right in FIG. 3), as the indicator 2 is manually reset and the cradle 70 is relatched. In this manner, the second side 20 of the first projection 12 moves and engages catch 72 of housing 52 thereby retaining indicating member 4 against the spring bias and preventing it from protruding from the housing 52.

Figure 5:
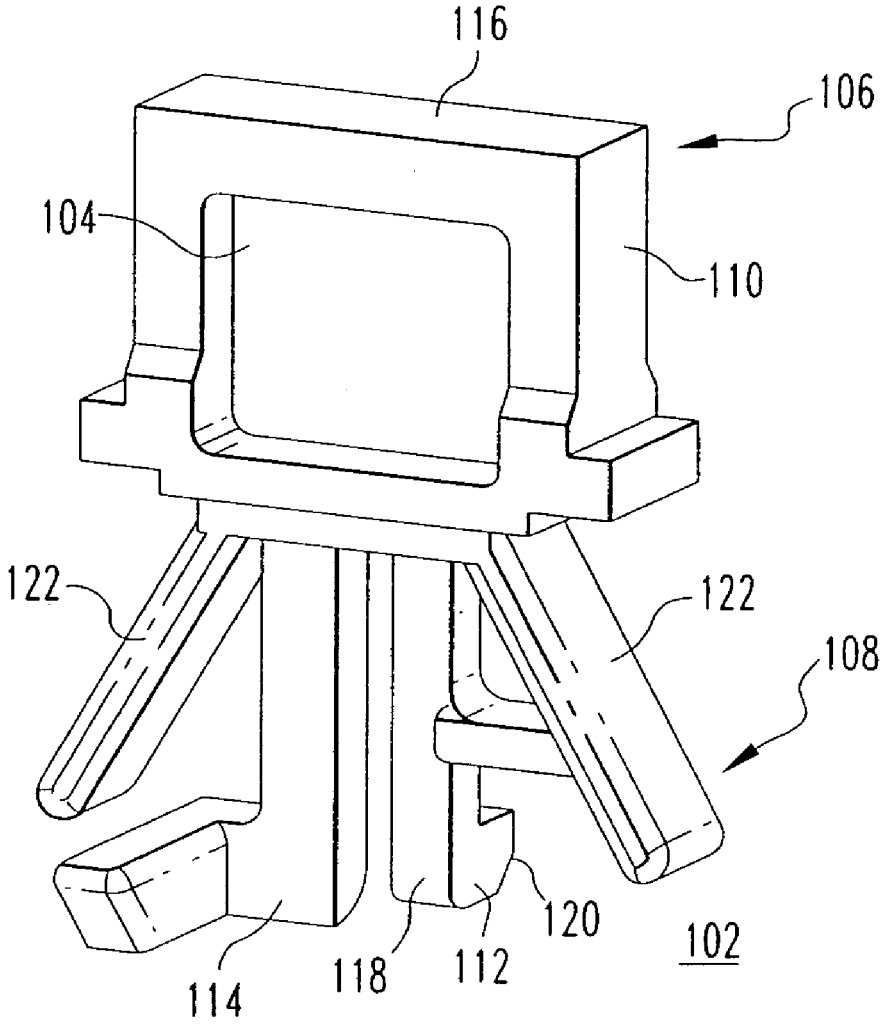
FIG. 5 is an isometric view of a trip indicating member in accordance with another embodiment of the invention.

It will be appreciated that the present invention contemplates trip indicators (e.g., 2) having a variety of alternative suitable trip indicating member (e.g., 4) configurations other than those described and illustrated herein. For example, FIG. 5 illustrates an alternative embodiment of a trip indicating member 104 having a pair of resilient extensions 122. In this embodiment, like components are numbered substantially similarly to the reference numbering of the corresponding features in the previously disclosed embodiment of FIGS. 1–4, but under reference characters starting with 102. Specifically, the aforementioned trip indicator 102 generally corresponds to the trip indicator 2 of FIGS. 1–4.

In the example of FIG. 5, rather than the linear spring 24 previously discussed, the bias of the trip indicating member 104 is provided by way of the flexural properties of the trip indicator 104 and, in particular, the pair of resilient extensions 122. The resilient extensions 122 are adapted to bias the trip indicating member 4 upward thereby eliminating the requirement of the separate linear spring 24. Specifically, the resilient extensions 122 are structured to engage the housing 52 (not shown in FIG. 5) in order to bias the trip indicating member 104 toward the second opening 56 (FIGS. 1–4) of housing 52 (FIGS. 1–4). It will, however, be appreciated that any other suitable flexural, resilient element (not shown) could be employed. The remainder of the features of the trip indicating member 104 of FIG. 5 are substantially similar in function to the trip indicating member 4 previously discussed herein. For example, the second end 108 of the trip indicating member 104 includes first and second projections 112, 114. The first projection 112 includes first and second sides 18, 120 and exhibits flexural properties permitting it to have a deflected position, wherein the cradle 70 (see, e.g., FIG. 3) engages the first side 18 and deflects the first projection 112 causing it to engage catch 72 of housing 52 (see, e.g., FIG. 3), when the separable contacts 58 (FIG. 1) are not tripped and the cradle 70 is latched (FIG. 3).

Accordingly, the present invention provides a trip indicator 2,102 which not only provides a visual indication of a trip condition, which can be readily viewed from any elevation with respect to the circuit breaker 50, but it also provides an operating handle 62 locking feature which prevents the operating handle 62 from being arbitrarily moved from the tripped position. The unique flexural properties of the trip indicating member 4,104 facilitate the ability and the trip indicator 2,102 to perform this dual function.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A circuit breaker comprising:

a housing including first and second openings;

separable contacts enclosed within said housing;

an operating mechanism including an operating handle for opening and closing said separable contacts, said operating handle including a first end and a second end, the first end protruding from the first opening of said housing and moving among OFF, ON and tripped positions corresponding to said separable contacts being open, closed and tripped open, respectively; and a trip indicator comprising:

a trip indicating member including a first end and a second end, said first end of said trip indicating member having a trip indicia, said second end of said trip indicating member including a first portion and a second portion, wherein said first portion is engaged by said operating mechanism when said separable contacts are not tripped open, in order to prevent said trip indicia from being viewable at the second opening of said housing, and wherein said first portion is disengaged and released by said operating mechanism when said separable contacts are tripped open, causing said trip indicating member to move in order that said trip indicia is viewable at the second opening of said housing and said second portion of the second end of said trip indicating member engages and locks the second end of said operating handle.

2. The circuit breaker of claim 1 wherein said operating mechanism further includes a cradle pivotally mounted within said housing proximate the second end of said operating handle; wherein said cradle is moveable between latched and unlatched positions corresponding to said separable contacts being closeable and tripped open, respectively; wherein said cradle engages said first portion of the second end of said trip indicating member when said cradle is latched and said separable contacts are not tripped open, thereby preventing the first end of said trip indicating member from being viewable at the second opening of said housing; and where said cradle disengages and releases said first portion when said cradle is unlatched in response to said tripping condition tripping open said separable contacts.

3. The circuit breaker of claim 2 wherein said trip indicia is a protrusion of the first end of said trip indicating member which protrudes from the second opening of said housing when said cradle is in said unlatched position and said separable contacts are tripped open; and wherein said trip indicating member does not protrude when said cradle is latched and said separable contacts are not tripped.

4. The circuit breaker of claim 3 wherein the second end of said operating handle includes a recess; wherein said first and second portions of the second end of said trip indicating member are first and second projections; wherein said first projection is engaged and disengaged by said cradle when said cradle is latched and unlatched, respectively, in response to said separable contacts being closeable and tripped open, and wherein said second projection engages the second end of said operating handle at said recess in order to lock said operating handle when said separable contacts are tripped open, said cradle is unlatched and the first end of said trip indicating member is protruding from said housing.

5. The circuit breaker of claim 4 wherein said first projection further includes first and second sides; wherein the first side of said first projection is engaged by said cradle when said cradle is latched and said separable contacts are not tripped open; and wherein the second side of said first projection engages said housing in order to prevent the first end of said trip indicating member from protruding therefrom when said separable contacts are not tripped open and said cradle is latched.

6. The circuit breaker of claim 5 wherein said trip indicating member is biased towards protruding said protrusion of the first end thereof from the second opening of said housing; and wherein said separable contacts, when tripped open, cannot be reset unless said protrusion of the first end of said trip indicating member is first depressed against said bias in order that said second projection disengages said recess at the second end of said operating handle which also causes the second side of said first projection to engage said housing thereby preventing the first end of said trip indicating member from protruding therefrom.

7. The circuit breaker of claim 6 wherein said trip indicating member further includes at least one resilient extension; and wherein said at least one resilient extension is structured to provide said bias of said trip indicating member.

8. The circuit breaker of claim 6 wherein said housing further includes a bias member, which provides said bias of said trip indicating member.

9. The circuit breaker of claim 8 wherein said bias member is a spring.

10. The circuit breaker of claim 6 wherein said trip indicating member is made from a resilient material having flexural properties; wherein said housing further includes a catch; wherein said first projection moves between an undeflected position and a deflected position; wherein, in said undeflected position, said cradle does not engage the first side of said first projection and the second side of said first projection does not engage said catch, in order that said trip indicating member is free to move in accordance with said bias, when said cradle is unlatched and said separable contacts are tripped open; and wherein, in the deflected position, said cradle engages the first side of said first projection in order to deflect it causing the second side thereof to engage said catch and hold said trip indicating member against said bias, thereby preventing it from protruding from the second opening of said housing when said separable contacts are not tripped and said cradle is latched.

11. A circuit breaker comprising:

a housing including first and second openings;

separable contacts enclosed within said housing;

an operating mechanism including a cradle and an operating handle for opening and closing said separable contacts, said operating handle including a first end and a second end, the first end protruding from the first opening of said housing and moving among OFF, ON and tripped positions corresponding to said separable contacts being open, closed and tripped open, respectively, said cradle pivotally mounted within said housing proximate the second end of said operating handle, said cradle moveable between a latched position and an unlatched position corresponding to said separable contacts being tripped open in response to a trip condition;

a trip indicator comprising:

a trip indicating member including a first end and a second end, said first end of said trip indicating member having a trip indicia, said second end of said trip indicating member including a first portion and a second portion, wherein said cradle engages said first portion of the second end of said trip indicting member when said cradle is latched and said separable contacts are not tripped open, in order that the first end of said trip indicating member does not protrude from said housing, wherein said cradle disengages and releases said first portion of the second end of said trip indicating member when said cradle is unlatched and said separable contacts are tripped open, causing said trip indicating member to move in order that the first end of said trip indicating member protrudes from the second opening of said housing; and wherein the trip indicating member is biased towards protruding the first end thereof from the second opening of said housing; wherein said housing further includes a catch; wherein said second portion of the second end of said trip indicating member is a projection; and wherein said cradle engages said first portion of the second end of said trip indicating member when said separable contacts are not tripped and said cradle is latched, which causes said projection to engage said catch in order to prevent the first end of said trip indicating member from protruding from said housing.

12. The circuit breaker of claim 11 wherein said housing further includes a bias member, which provides said bias of said trip indicating member.

13. The circuit breaker of claim 12 wherein said bias member is a spring.

14. The circuit breaker of claim 11 wherein said trip indicating member is made from a resilient material having flexural properties; wherein the second end of said trip indicating member moves between an undeflected position and a deflected position; wherein, in said undeflected position, when said cradle is unlatched and said separable contacts are tripped open, said cradle does not engage said first portion and said projection does not engage said catch of said housing, in order that said trip indicating member is free to move in accordance with said bias; and wherein, in said deflected position, when said separable contacts are not tripped and said cradle is latched, said cradle engages said first portion of the second end of said trip indicating member in order to deflect it causing said projection to engage said catch and hold said trip indicating member against said bias thereby preventing the first end thereof from protruding from the second opening of said housing.

15. The circuit breaker of claim 14 wherein said trip indicating member further includes at least one resilient extension, which is structured to provide said bias of said trip indicating member.

16. A circuit breaker comprising:

a housing including first and second openings;

separable contacts enclosed within said housing;

an operating mechanism including a cradle and an operating handle for opening and closing said separable contacts, said operating handle including a first end and a second end, the first end protruding from the first opening of said housing and moving among OFF, ON and tripped positions corresponding to said separable contacts being open, closed and tripped open, respectively, said cradle pivotally mounted within said housing proximate the second end of said operating handle, said cradle moveable between a latched position and an unlatched position corresponding to said separable contacts being tripped open in response to a trip condition;

a trip indicator comprising:

a trip indicating member including a first end and a second end, said first end of said trip indicating member having a trip indicia, said second end of said trip indicating member including a first portion and a second portion, wherein said cradle engages said first portion of the second end of said trip indicting member when said cradle is latched and said separable contacts are not tripped open, in order that the first end of said trip indicating member does not protrude from said housing, wherein said cradle disengages and releases said first portion of the second end of said trip indicating member when said cradle is unlatched and said separable contacts are tripped open, causing said trip indicating member to move in order that the first end of said trip indicating member protrudes from the second opening of said housing; and wherein said second portion of the second end of said trip indicating member is structured to engage and lock the second end of said operating handle when said separable contacts are tripped open, said cradle is unlatched and the first end of said trip indicating member protrudes from the second opening of said housing.

* * * * *